US005785360A

United States Patent [19]

Nordfeldt et al.

[11] Patent Number: 5,785,360

[45] Date of Patent: Jul. 28, 1998

[54] THREAD COUPLING FOR DRILL STRING ELEMENTS FOR PERCUSSIVE DRILLING

[75] Inventors: Leif Nordfeldt, Söderbärke; Karl-Axel Stjernström, Fagersta, both of Sweden

[73] Assignee: Uniroc AB, Fagersta, Sweden

[21] Appl. No.: 849,322

[22] PCT Filed: Nov. 21, 1995

[86] PCT No.: PCT/SE95/01381

§ 371 Date: May 20, 1997

§ 102(e) Date: May 20, 1997

[87] PCT Pub. No.: WO96/16246

PCT Pub. Date: May 30, 1996

[30] Foreign Application Priority Data

Nov. 23, 1994 [SE] Sweden ..... 9404051

[51] Int. Cl.[6] ..... F16L 25/00

[52] U.S. Cl. ..... 285/328; 285/288.1; 285/289.1; 285/390; 285/422; 403/343

[58] Field of Search ..... 285/328, 333, 285/334, 355, 390, 422, 288.1, 289.1; 403/343

[56] References Cited

U.S. PATENT DOCUMENTS

| | | | |
|---|---|---|---|
| 2,052,019 | 8/1936 | Baker | 403/343 |
| 2,772,899 | 12/1956 | Evans | 285/333 |
| 3,489,445 | 1/1970 | Kammerer | 403/343 X |
| 4,687,368 | 8/1987 | Eklof et al. | 285/334 X |
| 4,968,068 | 11/1990 | Kenneth . | |

FOREIGN PATENT DOCUMENTS

| | | |
|---|---|---|
| 671024 | 6/1994 | Australia . |
| 984664 | 7/1951 | France . |
| 8704487 | 7/1987 | WIPO . |

*Primary Examiner*—Dave W. Arola

[57] ABSTRACT

A thread coupling for percussive drilling has a first drill string element (2) with an internal thread (3) and a second drill string element (6) with a spigot (7) which is provided with an external thread (8) for cooperation with the internal thread (3). A contact surface (10) on the second drill string element (6) is lined with a wear resistant additional material which covers 50–100%, preferably, 50–90%, of the contact surface. The wear resistant material is preferably a stellite which has been applied by means of plasma welding, or is a ring which has been soldered to the contact surface.

16 Claims, 1 Drawing Sheet

THREAD COUPLING FOR DRILL STRING ELEMENTS FOR PERCUSSIVE DRILLING

The present invention relates to a thread coupling for drill string elements for percussive drilling.

In earlier efforts to prolong the service life of the drill tubes at percussive drilling, see U.S. Pat. No. 4,968,068, it is ascertained that the spigot on one of the drill string elements is somewhat shorter, 0–1 mm, than the distance between the free end and the bottom surface of the sleeve formed part of the other drill string element. The reason for arranging this clearance at the manufacturing is that one wants to assure that contact is not achieved only between the outer end of the spigot and the bottom surface of the sleeve formed part. It is also said that the ideal condition is that one has contact both at the free end and the bottom surface of the sleeve formed part. This condition cannot be achieved at the manufacturing because of manufacturing tolerances. It is also said that the original bottom clearance between the two drill string elements will be eliminated because of wear before 20% of the service life of the thread coupling has been used. The goal according to U.S. Pat. No. 4,968,068 is thus to keep the original bottom clearance small so that one quickly obtains the double contact between the two drill string components. This results in the drawbacks that the hardening at the free end of the sleeve formed part and the cooperating contact surface is badly used since one very soon transfers the wear to the threads of the two drill string elements.

The present invention, which is defined in the appended claims, aims at increasing the service life of the drill string elements through lining a contact surface on one of the drill string elements or the free end of the other drill string element with a wear resistant additional material, e.g. a stellite, applied by means of welding or soldering. It is also an aim of the present invention to obtain the increase of the service life at a substantiallly lower cost.

Figure 1:
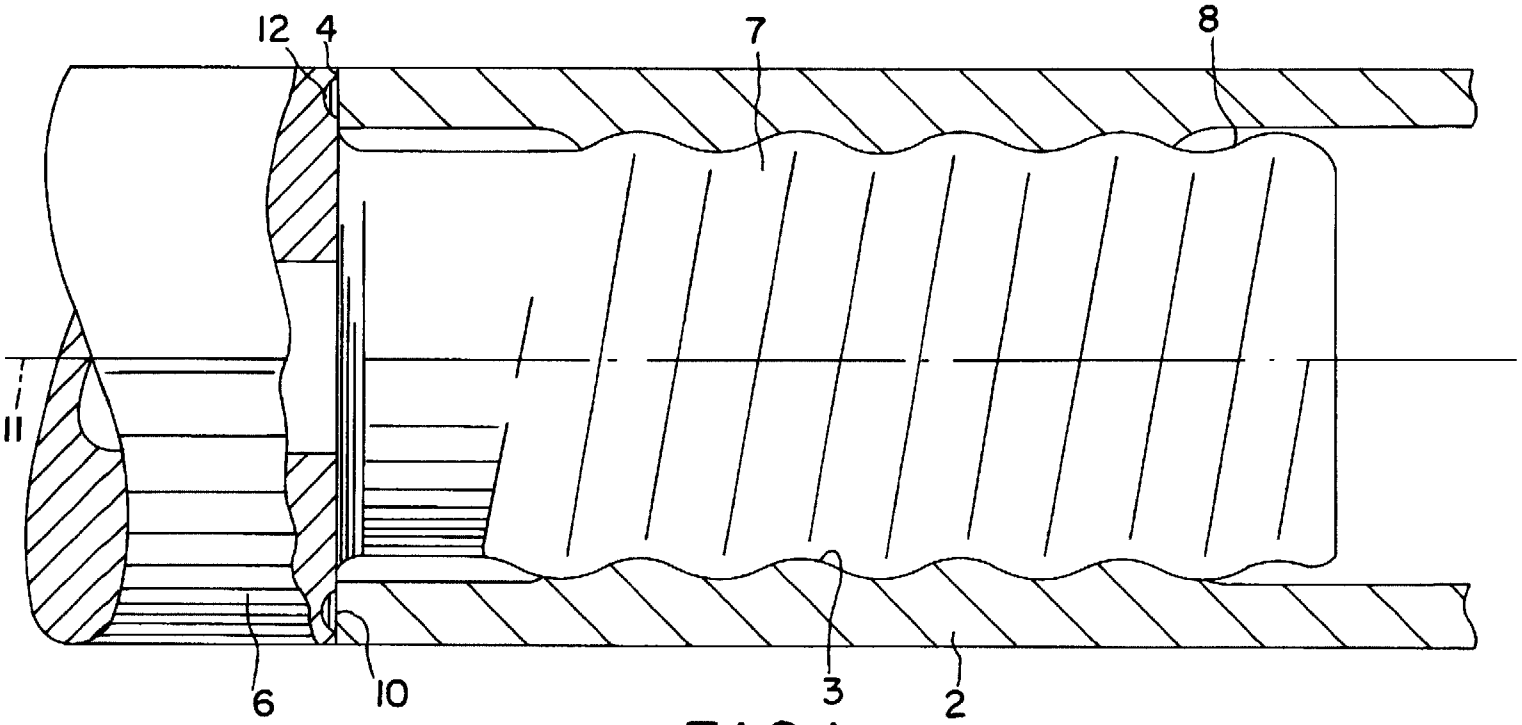
Figure 2:
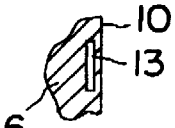

Two embodiments of the invention are described below with reference to the accompanying drawings in which FIG. 1 shows a first embodiment of a thread coupling according to the invention, partly in section FIG. 2 shows a part of a thread coupling according to a second embodiment of the invention.

The embodiment of the invention shown in FIG. 1 comprises a first drill string element 2 and a second drill string element 6. The first drill string element 2 is provided with an internal thread 3 and a free end 4. The second drill sting element 6 is provided with a spigot 7 having an external thread 8. At the inner end of the spigot the second drill string element is provided with a contact surface 10. The contact surface 10 and the free end 4 are situated in a plane being perpendicular to the longitudinal axis 11 of the thread coupling and are intended for abutting each other. The annular contact surface 10 is provided with a lining of a wear resistant additional material. It has turned out to be suitable to choose a stellite which makes it possible to keep the porosity low. An example of such a material is stellite 6. The material should have about the same hardness as the underlying material, i.e. $H_{RC}$=35–45, and cover 50–100%, preferably 50–90%, of the contact surface. It har turned out to be particularly advantageous if the wear resistant additional material does not extend entirely out to to the external diameter of the drill string element since this decreases the risk that the wear resistant additional material falls off during operation. The depth of the lining should be 0.5–5 mm. It has turned out to be particularly advantageous to apply the wear resistant material by means of plasma welding.

FIG. 2 shows a part of a modified embodiment of the thread coupling. The wear resistant material is here made as a ring 13 which has been soldered to the contact surface 10. As material a hard metal, e.g. a carbide containing 5–20% Co, is chosen. The embodiment is in other respects made as in the example in FIG. 1.

We claim:

1. Thread coupling for percussive drilling comprising a first drill string element (2) provided with an internal thread (3) at a free end (4) and a second drill string element (6) provided with a spigot (7) which is provided with an external thread (8) for cooperation with the internal thread (3) on the first drill string element (2), whereby said second drill string element (6) is provided with a contact surface (10) for cooperation with said free end (4) on said first drill string element (2), characterized in that said contact surface (10) or said free end (4) is provided with a lining (12) of a wear resistant additional material which has been applied by means of welding or soldering, that said wear resistant additional material covers 50–100% of said contact surface (10) and has a depth of 0.5–5 mm.

2. Thread coupling according to claim 1, characterized in that said wear resistant material is a stellite.

3. Thread coupling according to claim 2, characterized in that said wear resistant material covers 50–90% of said contact surface (10) and has a maximum diameter which is smaller than the outer diameter of said contact surface.

4. Thread coupling according to claim 2, characterized in that said wear resistant material has been applied by means of plasma welding.

5. Thread coupling according to claim 4, characterized in that said wear resistant material covers 50–90% of said contact surface (10) and has a maximum diameter which is smaller than the outer diameter of said contact surface.

6. Thread coupling according to claim 2, characterized in that said wear resistant material is a ring (13) which has been soldered to said contact surface (10).

7. Thread coupling according to claim 6, characterized in that said wear resistant material covers 50–90% of said contact surface (10) and has a maximum diameter which is smaller than the outer diameter of said contact surface.

8. Thread coupling according to claim 6, characterized in that said ring is made of a hard metal comprising 5–20% Co.

9. Thread coupling according to claim 8, characterized in that said wear resistant material covers 50–90% of said contact surface (10) and has a maximum diameter which is smaller than the outer diameter of said contact surface.

10. Thread coupling according to claim 1, characterized in that said wear resistant material has been applied by means of plasma welding.

11. Thread coupling according to claim 10, characterized in that said wear resistant material covers 50–90% of said contact surface (10) and has a maximum diameter which is smaller than the outer diameter of said contact surface.

12. Thread coupling according to claim 1, characterized in that said wear resistant material is a ring (13) which has been soldered to said contact surface (10).

13. Thread coupling according to claim 12, characterized in that said wear resistant material covers 50–90% of said contact surface (10) and has a maximum diameter which is smaller than the outer diameter of said contact surface.

14. Thread coupling according to claim 12, characterized in that said ring is made of a hard metal comprising 5–20% Co.

15. Thread coupling according to claim 14, characterized in that said wear resistant material covers 50–90% of said contact surface (10) and has a maximum diameter which is smaller than the outer diameter of said contact surface.

16. Thread coupling according to claim 1, characterized in that said wear resistant material covers 50–90% of said contact surface (10) and has a maximum diameter which is smaller than the outer diameter of said contact surface.

* * * * *